US006273731B1

(12) United States Patent
Bishop et al.

(10) Patent No.: US 6,273,731 B1
(45) Date of Patent: Aug. 14, 2001

(54) LOW PROFILE ELECTRICAL CONNECTOR

(75) Inventors: Peter G. Bishop, Isleham Ely Cambridgeshire; David E. Rippington, Stetchworth New Market, both of (GB)

(73) Assignee: AVX Corporation, Myrtle Beach, SC (US)

( * ) Notice: Subject to any disclaimer, the term of this patent is extended or adjusted under 35 U.S.C. 154(b) by 0 days.

(21) Appl. No.: 09/353,418

(22) Filed: Jul. 15, 1999

Related U.S. Application Data

(63) Continuation-in-part of application No. 09/232,999, filed on Jan. 19, 1999, now Pat. No. 6,077,089.

(51) Int. Cl.[7] ..... H01R 12/00

(52) U.S. Cl. ..... 439/66; 439/732; 439/744; 439/752.5; 439/862

(58) Field of Search ..... 439/61, 66, 74, 439/72, 732, 733.1, 744, 752.5, 862, 872, 746

(56) References Cited

U.S. PATENT DOCUMENTS

| | | | |
|---|---|---|---|
| 3,550,062 | 12/1970 | Drenten et al. . | |
| 3,815,077 | 6/1974 | Anhalt et al. . | |
| 3,873,173 | 3/1975 | Anhalt . | |
| 3,960,424 | 6/1976 | Weisenburger . | |
| 3,993,384 | 11/1976 | Dennis et al. . | |
| 4,035,046 | 7/1977 | Kloth . | |
| 4,050,755 | 9/1977 | Hasircoglu . | |
| 4,052,118 | 10/1977 | Scheingold et al. . | |
| 4,057,311 | 11/1977 | Evans . | |
| 4,093,330 | 6/1978 | Pittman . | |
| 4,176,895 | 12/1979 | Aldridge . | |
| 4,188,085 | 2/1980 | Aldridge et al. . | |
| 4,220,383 | 9/1980 | Scheingold et al. . | |
| 4,268,102 | 5/1981 | Grabbe . | |
| 4,341,433 | 7/1982 | Cherian et al. . | |
| 4,359,252 | 11/1982 | Olsson et al. . | |
| 4,494,807 | 1/1985 | Cosmo . | |
| 4,511,201 | 4/1985 | Baker et al. . | |
| 4,548,451 | 10/1985 | Bernarr et al. . | |
| 4,553,192 | 11/1985 | Babuka et al. . | |
| 4,660,920 | 4/1987 | Shibano . | |
| 4,664,458 | 5/1987 | Worth . | |
| 4,806,104 | * 2/1989 | Cabourne | 439/66 |
| 4,927,369 | 5/1990 | Grabbe et al. . | |
| 4,995,814 | 2/1991 | Weidler . | |
| 4,998,886 | 3/1991 | Werner . | |
| 5,041,016 | 8/1991 | Machado et al. . | |
| 5,052,943 | 10/1991 | Davis . | |
| 5,199,889 | 4/1993 | McDevitt, Jr. . | |
| 5,226,826 | 7/1993 | Nillson et al. . | |

(List continued on next page.)

FOREIGN PATENT DOCUMENTS

| | | |
|---|---|---|
| 9112605.3 | 2/1992 | (DE) . |
| 0346206A1 | 12/1989 | (EP) . |
| 0463487B1 | 1/1992 | (EP) . |
| 435363 | 3/1992 | (JP) . |
| 454111 | 5/1992 | (JP) . |

*Primary Examiner*—Paula Bradley
*Assistant Examiner*—Truc Nguyen
(74) *Attorney, Agent, or Firm*—Dority & Manning, P.A.

(57) ABSTRACT

A thin profile electrical connector includes an insulating body member having a longitudinally extending leg defined between opposite ends. A plurality of adjacently disposed and spaced apart connector elements are mounted on the longitudinal leg, for example within recesses or grooves defined transversely to the longitudinal leg. Each connector element includes a closed end and an open end defined by extending arms. The closed end wraps around the longitudinal leg at each connector position. Each connector element includes outwardly facing contact surfaces defined on each of the extending arms for mating contact with respective pads of separate facing circuit boards.

37 Claims, 13 Drawing Sheets

U.S. PATENT DOCUMENTS

| | | | | |
|---|---|---|---|---|
| 5,230,632 | | 7/1993 | Baumberger et al. . | |
| 5,234,353 | | 8/1993 | Scholz et al. . | |
| 5,259,769 | | 11/1993 | Cruise et al. . | |
| 5,306,163 | | 4/1994 | Asakawa . | |
| 5,308,252 | | 5/1994 | Mroczkowski et al. . | |
| 5,310,352 | | 5/1994 | Mroczowski et al. . | |
| 5,358,411 | * | 10/1994 | Mroczkowski et al. | 439/66 |
| 5,378,160 | | 1/1995 | Yumibe et al. . | |
| 5,479,320 | | 12/1995 | Estes et al. . | |
| 5,484,295 | * | 1/1996 | Mowry et al. | 439/66 |
| 5,498,166 | | 3/1996 | Rothenberger . | |
| 5,584,713 | | 12/1996 | Kato et al. . | |
| 5,586,890 | | 12/1996 | Braun . | |
| 5,653,598 | | 8/1997 | Grabbe . | |
| 5,655,913 | * | 8/1997 | Castaneda et al. | 439/66 |
| 5,746,607 | | 5/1998 | Bricaud et al. . | |
| 5,863,210 | | 1/1999 | Reisinger . | |
| 5,879,169 | | 3/1999 | Wu . | |
| 6,077,089 | * | 6/2000 | Bishop et al. | 439/66 |

* cited by examiner

LOW PROFILE ELECTRICAL CONNECTOR

REFERENCE TO RELATED APPLICATIONS

The present application is a continuation in part of a parent application Ser. No. 09/232,999 filed on Jan. 19, 1999, (U.S. Pat. No. 6,077,089).

BACKGROUND OF THE INVENTION

The present invention relates to electrical connectors, and more particularly to electrical connectors used to interconnect electronic subassemblies, for example printed circuit boards, which are required to be mounted adjacent to each other often in a vertically stacked configuration.

Prior art methods are known for interconnecting electronic assemblies, particularly circuit boards. For example, it is well known to hard wire the boards together, or to use edge connectors carried by the boards which engage with complimentary fixed edge connectors carried within a frame in which the boards are mounted.

A concern with conventional board-to-board connectors is the limited space for connection of the boards or assemblies within the electronic device. With conventional connectors utilizing a plurality of terminals laterally arranged at intervals in a housing, one contact leg of each terminal is soldered to the circuit pattern of one printed board and the other leg of the contact is soldered to the circuit pattern on the other printed board. As a result of the narrow intervals between the terminals and vertical distance between the boards, it is extremely difficult to solder each of the terminals without bridging an adjacent terminal with solder. The soldering procedure is a time consuming and difficult task.

One suggested improvement is disclosed in the European patent specification Publication No. 0 463 487 published on Jan. 2, 1992. Therein, an electrical connector is described having a terminal housing with a plurality of terminals laterally arranged and fixed at regular intervals with two leg contacts of each terminal extending from the housing. A connector casing loosely accommodates the terminal housing and permits the terminal housing to slide up and down within the casing. The casing in turn has extensions for fixing it to one printed board and means to permit the printed board to come into contact with the other terminals. This device, however, requires an adequate space between the circuit boards to accommodate the connector casing and terminal housing. The minimum distance or height between adjacent circuit boards is thus unnecessarily limited, particularly in a stacked configuration of circuit boards.

The published PCT Application No. WO 97/02631 discloses an electrical connector for connecting adjacent circuit boards, including stacked circuit boards. The connector includes a generally I-shaped insulating body defining a plurality of adjacent recesses into which identical contact elements are mounted. The contact elements have at least one resilient contact arm that resiliently bends or moves within the body recess.

U.S. Pat. No. 5,041,016 and the European Patent Specification No. 0 346 206 disclose other types of printed circuit board connectors.

OBJECTS AND SUMMARY OF THE INVENTION

It is a principal object of the present invention to provide an improved electrical connector particularly suited for interconnecting stacked circuit boards.

Still a further object of the present invention is to provide an electrical connector having a relatively minimum height so as to interconnect vertically stacked circuit boards with a minimal separation distance therebetween.

Additional objects and advantages of the invention will be set forth in part in the following description, or may be obvious from the description, or may be learned through practice of the invention.

In accordance with the objects and purposes of the invention, a low or "thin" profile electrical connector assembly is provided for interconnecting physically distinct circuit boards, particularly in a stacked configuration. The electrical connector includes at least one insulating body member having opposite ends and at least one longitudinally extending leg defined between the ends. It should be appreciated that a plurality of such legs may be provided. A plurality of adjacently disposed and spaced apart connector elements are disposed on each of the legs transverse to the longitudinal direction. Preferably, the connectors are disposed at distinct connector positions defined along the leg. For example, the connector positions may be grooves or recesses that are defined at least partly around a circumference of the leg. The grooves or recesses may further comprise engaging or positioning surfaces defined therein that are configured to retain and position each connector element at each connector position along the leg member.

The connector elements are generally open-ended or U-shaped and have a closed end and an open end defined by opposite arm members. The closed ends wrap around the leg at each connector position. Each connector element also includes an outwardly facing contact surface defined on each of the extending arms. In this manner, the connector is disposed between stacked circuit boards with the arms being in mating contact with respective pads of separate facing circuit boards.

Preferably, at least one of the arms of the connectors is an angled resilient arm disposed for pressing mating contact with a respective pad of one of the circuit boards. In this embodiment, the other connector arm may comprise a generally rigid arm that is disposed adjacent to an outer surface of the leg. Thus, the rigid arm may be soldered to its respective circuit board pad with the resilient arm being maintained in pressing contact with its respective pad without soldering. Alternatively, the resilient arm could also be soldered to its respective pad.

The resilient arm may be angled away from the leg and is preferably not in contact with the leg. The resilient arm does not derive its resiliency from being folded back onto the leg as this would limit the minimal height of the assembly due to additional bends in the connector elements. The resilient arm may also have a length so as to extend past, and even over, the longitudinal edge of the leg, for example within the groove or recess defined in the leg. It is preferred that the connector arms do not come into contact with each other.

In an alternative preferred embodiment, both of the connector arms may be resilient arm members disposed for pressing mating contact with respective pads of facing circuit boards. In this embodiment, the arms may move into grooves or recesses defined in the leg of the insulating body upon being pressed against mating pads of the facing circuit boards. The resilient arms may have a length so as to extend over the leg without contacting each other when in the pressed mating configuration to further limit the thickness or profile of the connector.

The connector may also include alignment structure defined on at least one of the ends of the insulating body. The alignment structure can comprise any manner of configuration so as to engage with complimenting structure on the circuit boards to precisely position the connector relative to the circuit boards. For example, the alignment structure may comprise one of a male or female member for engagement with a respective female or male member on the circuit board.

A principal concern of the present invention is to provide a connector having a minimal height or profile. In this regard, a preferred embodiment of the connector comprises a height or profile of less than about 1.0 mm between the opposite arms of the connector elements when the connector is in mating contact between facing circuit boards, and preferably between about 0.5 mm and 0.7 mm. The profile height of the connector is not, however, a limitation of the invention.

In order to aid in precise positioning of the connector element on the circuit boards, engaging structures, such as male or female members, may be defined on the body member so that a positioning cap or similar device may be used to grasp and precisely locate the connector element on a circuit board. This structure may also serve as positioning or alignment structure matable with complimenting structure on the circuit boards.

It should be appreciated that a plurality of connector assemblies according to the invention can be utilized in any number of configurations. For example, a plurality of the connector assemblies could be placed on a single placement cap for placement in any desired pattern on a circuit board.

The present connector assembly is not limited by any particular material of construction and, in this regard, any conventional suitable materials may be utilized in manufacture of the connector assembly components.

Another important concern in any connector is the attachment of the connector elements to the insulating body. In this regard, the present invention preferably includes a retention device configured between the insulating body, particularly the leg, and the connector elements or strips.

The retention device has a configuration so as to engage and retain the closed end of the connector element around the leg edge while allowing the connector element to be initially slid onto the leg. The retention device ensures that the closed end of the connector elements are securely maintained in position along the leg yet allow for relatively simple construction and manufacturing processes.

In one preferred embodiment, the retention device comprises inclined surfaces that are disposed on either side of the leg proximate to the edge of the leg. For example, the inclined surfaces may be defined at the ends of the walls adjacent to the leg edge. In one preferred embodiment, the inclined surfaces are defined on inwardly projecting wall segments proximate to the leg edge. In this manner, the connector position or groove has a reduced width section between these inwardly projecting wall segments. The closed end of the connector element has a correspondingly reduced width so as to slide into the reduced width section of the connector position or groove between the wall segments.

The inclined surfaces are generally inclined from a low point adjacent to the leg edge to a high point that is further from the leg edge. The inclined surfaces may terminate in a generally vertical end wall. The end wall may be defined in a plane substantially perpendicular to the sides of the transverse walls disposed across the body leg.

The connector positions or grooves may have a generally increased width section adjacent to the reduced width section and extending across the leg. Likewise, the connector elements may have an increased width section adjacent to the reduced width section thereof. A shoulder may be defined between the reduced width and increased width sections of the connector elements.

In order to press the connector element onto the body, the increased width section of the arms slide up the inclined surfaces as the closed end of the connector element is pushed onto the leg at the connector position. The increased width section will drop over the generally vertical end walls and the reduced width closed end of the connector element will slide into the reduced width section between the inwardly projecting side wall segments as the connector element is pushed completely onto the leg. In the final position of the connector elements, the arms, and particularly the increased width section of the arms, will reside at least partially within the increased width section of the connector position grooves and the shoulders on the connector element will abut against the generally vertical end walls of the inwardly projecting segments. The reduced width closed end of the connecter element will slide securely down into the reduced width section of the connector position groove defined between the inwardly projecting wall segments.

Applicants have found that this particular retention configuration is very efficient at retaining the connector elements on the insulating body without requiring any sort of additional mechanical structure, adhesives, solder, or the like. It is a relatively inexpensive procedure to simply mold the retention device structure, such as the inclined surfaces and inwardly projecting walls, directly into the body member.

The invention will be described in greater detail below through preferred embodiments as illustrated in the attached figures.

DETAILED DESCRIPTION

Figure 1:
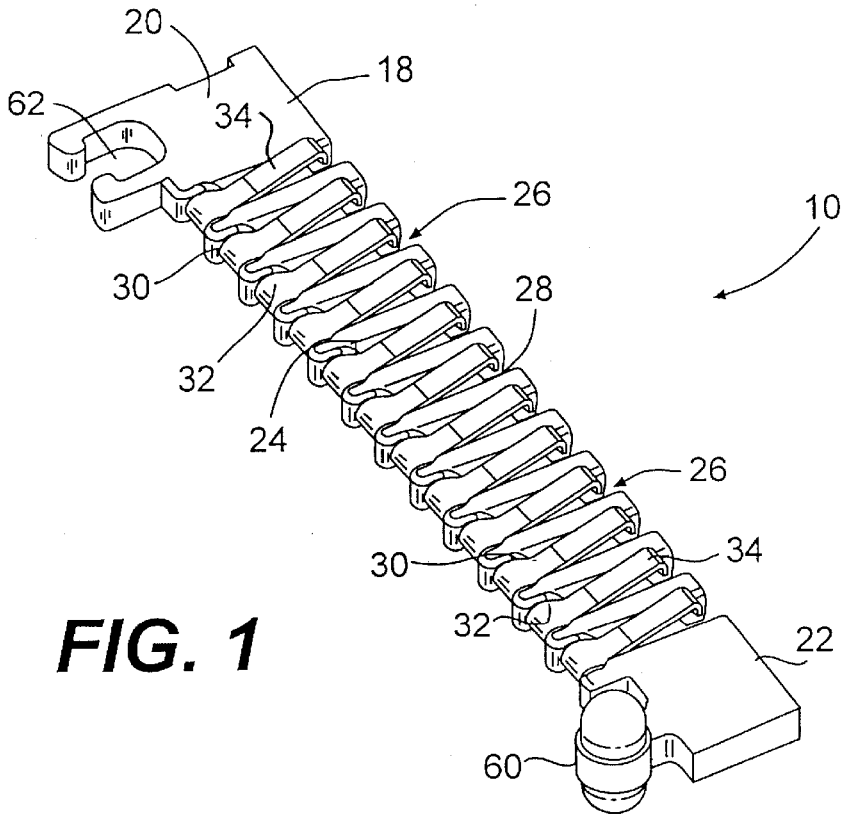
FIG. 1 is a perspective view of one embodiment of an electrical connector according to the invention.
Figure 2:
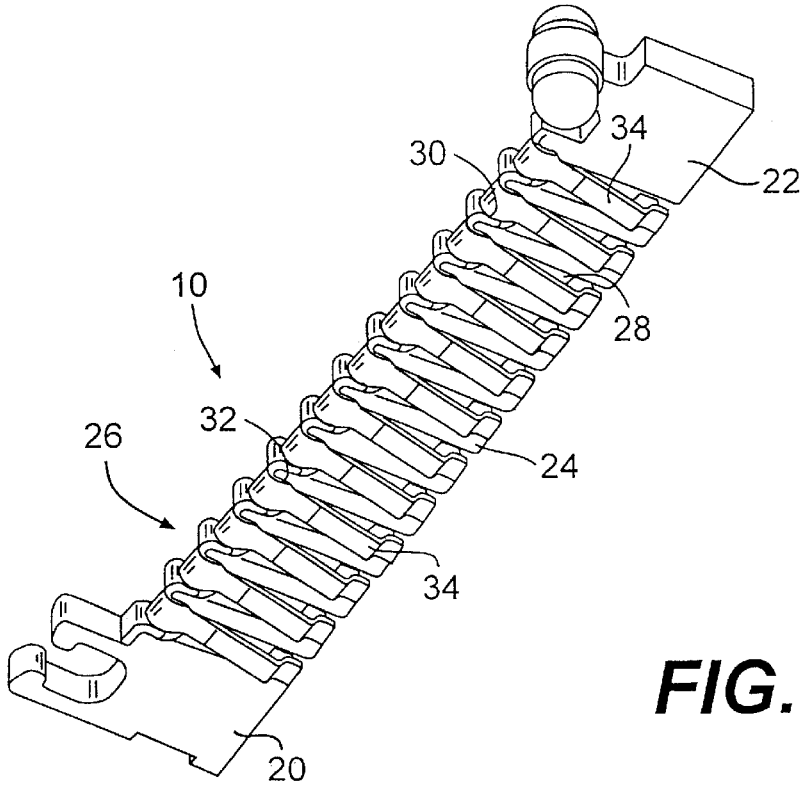
FIG. 2 is a perspective view of the underside of the connector shown in FIG. 1.

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiment can be used on another embodiment to yield still a third embodiment. It is intended that the present invention include such modifications and variations as come within the scope and spirit of the present invention.

Exemplary preferred embodiments of a connector assembly, generally 10, according to the invention are illustrated in the figures. Connector assembly 10 is particularly useful in interconnecting oppositely facing conductive members, such as circuit boards, in a stacked configuration while minimizing the stack height between the conductive members. For ease of explanation and illustration, the conductive members are illustrated and referred to as circuit boards herein. However, this is not a limitation of the invention, and the connector assemblies 10 can be used to interconnect any conventional conductive members.

Figure 3:
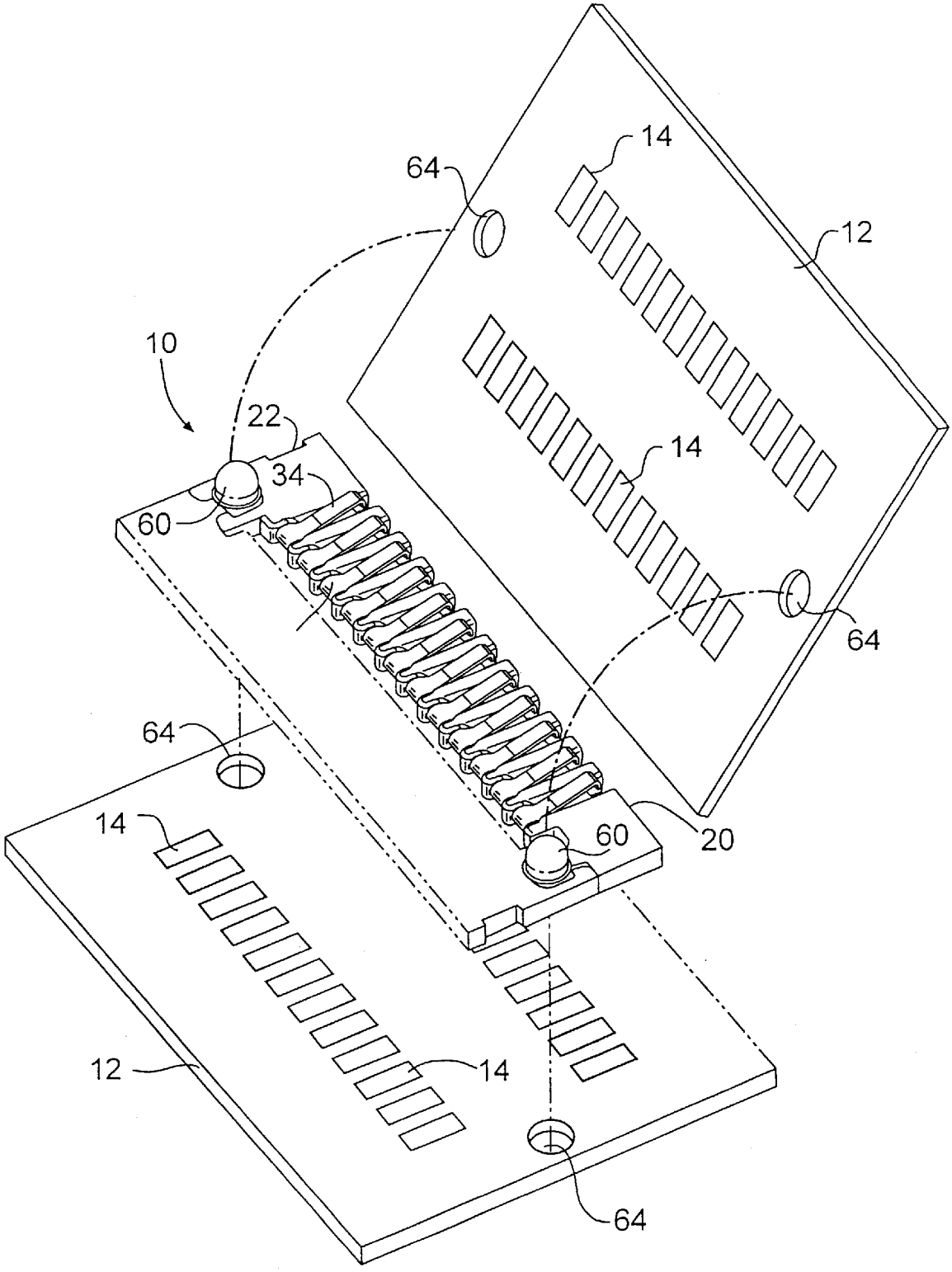
FIG. 3 is a perspective operational view of the connector indisposed between stacked circuit boards.
Figure 4:
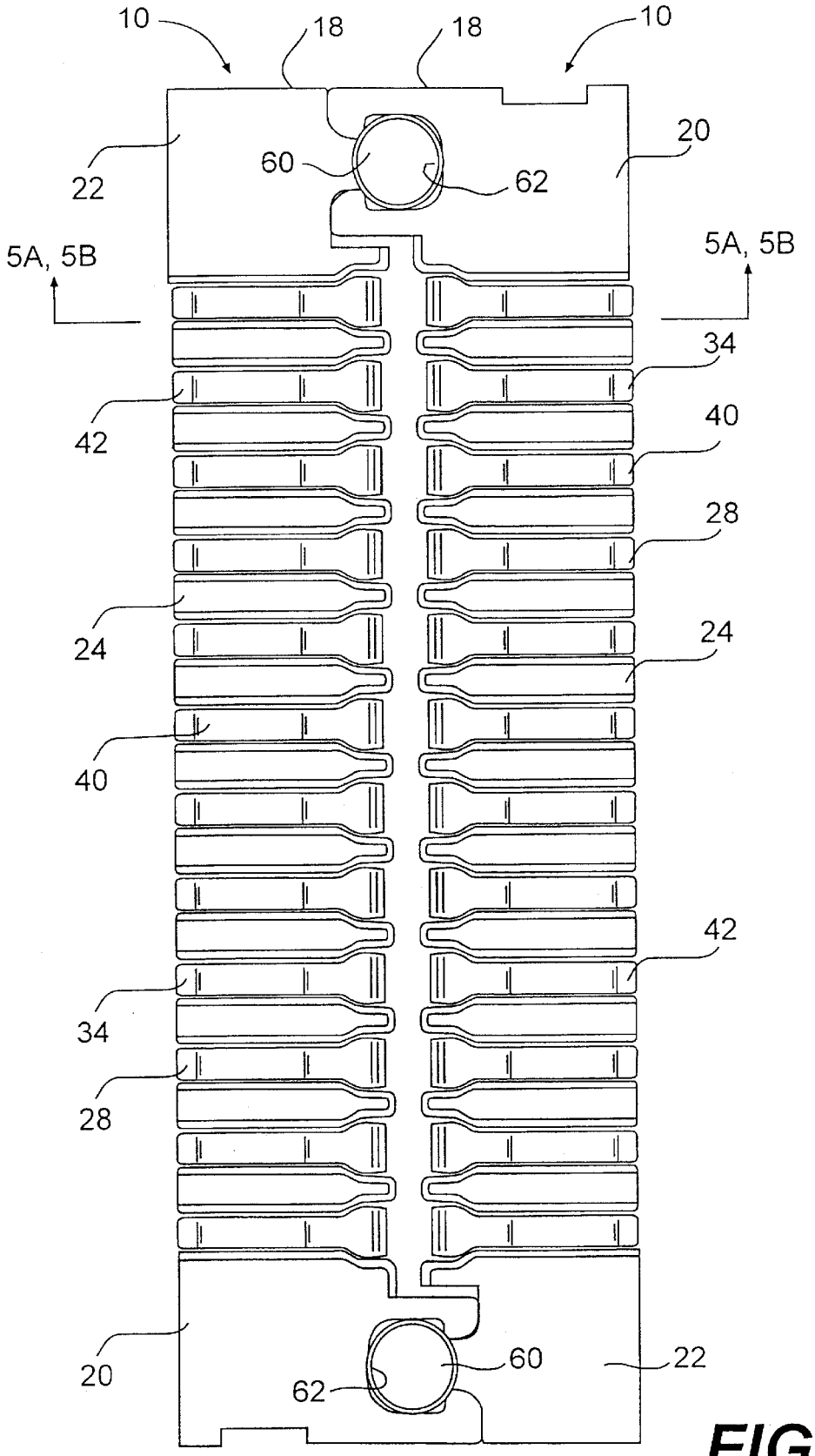
FIG. 4 is a view of one embodiment of a dual connector according to the invention.

The connector assembly 10 is particularly useful when a minimal stack height between opposing circuit boards is desired. In this regard, in preferred embodiments, the connector assembly allows for stack heights of less than about 1.0 mm, and preferably between about 0.5 to 0.7 mm. Connector assembly 10 provides an efficient and secure device for interconnecting pads 14 of conventional facing circuit boards 12, as illustrated in FIG. 3, for example.

Although the invention will be described generally in terms of interconnecting circuit boards, and with reference to structure sufficient for connecting the circuit boards, it should be understood that the boards and connector assemblies 10 according to the invention may further be retained or secured in frame structure of whatever electrical component the elements are contained in. Such configurations are well understood by those skilled in the art and need not be described in great detail herein.

Connector assembly 10 includes at least one insulating body member 18 having opposite ends 20, 22, and at least one longitudinally extending leg 24 extending between ends 20, 22. Insulating body 18 may be formed of any suitable insulating material, for example a high temperature plastic material such as STANYL high temperature resistant nylon.

A plurality of adjacently disposed and spaced apart connector elements 34 are positioned along each longitudinal leg 24. Connector elements 34 will be described in greater detail below.

Connector elements 34 are secured to longitudinal leg 24 in any suitable manner. One preferred manner illustrated in the figures is to define adjacent grooves or recesses 28 along the length of longitudinal leg 24 and to locate connector elements 34 within grooves 28. For example, elements 34 may be simply press-fitted into grooves 28. In this regard, grooves 28 may preferably contain structure such as wedge recesses 30 defining a mating press-fit surface for wedge edges 32 defined on connector elements 34. Any suitable structure may be utilized in this regard for securely retaining connector elements 34 in position along the length of longitudinal leg 24. Also, grooves 28 are defined around at least a portion of the circumference of longitudinal length 24, and preferably around the entire circumference thereof so as to define a space for resilient arms of connector elements 34 to be depressed into when connector assembly 10 is in mating connection with opposing circuit boards, as described in greater detail below.

Connector elements 34 are formed of any conventional conducting material, for example a conventional copper alloy material having a thickness of about 0.1 mm. Each connector element 34 is generally U-shaped having an open end 38 and a closed end 36. The term "U-shape" is used generically to denote any shape having an open end and a closed end, including V-shapes, C-shapes, etc. Closed end 36 generally wraps around an edge 25 of longitudinal leg 24, preferably within grooves 28 as illustrated in the figures. As discussed above, connector elements 34 may be press-fitted into grooves 28, or otherwise secured to longitudinal leg 24.

Open end 38 of each connector element 34 is defined by extending arms 40. Each arm 40 comprises an outwardly facing contact surface 42 positioned and configured for mating contact with respective pads 14 of circuit boards 12. In the embodiment illustrated in FIGS. 1 through 5*b*, each arm 40 is a resilient arm designed for pressing mating contact with a respective pad 14. Arms 40 are not in contact with leg 24 and do not derive their resiliency from being folded back onto the leg. Each leg 40 also has a length so as to extend past or over longitudinal edge 27 of leg 24, as particularly illustrated in FIGS. 5*a* and 5*b*. The resilient arms may extend at an angle of generally less than 90° from a horizontal plane through longitudinal leg 24. The resilient arms 40 are movable towards the leg into groove 28 upon being pressed against mating pads 14 of a circuit board 12 without contacting each other, as generally illustrated in FIG. 5*b*.

Figure 5A:
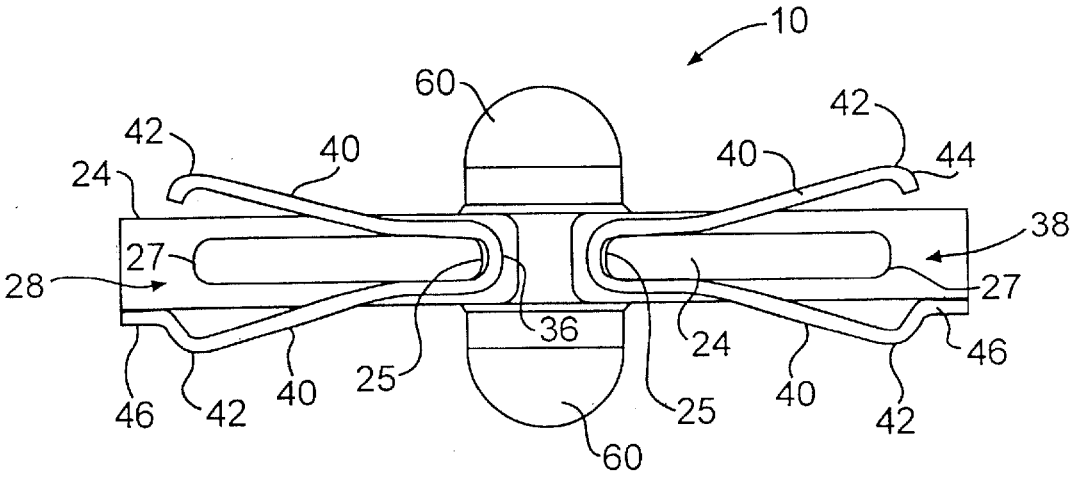
FIG. 5*a* is a cross-sectional view of the connector assembly of FIG. 4 taken along the lines indicated.
Figure 5B:
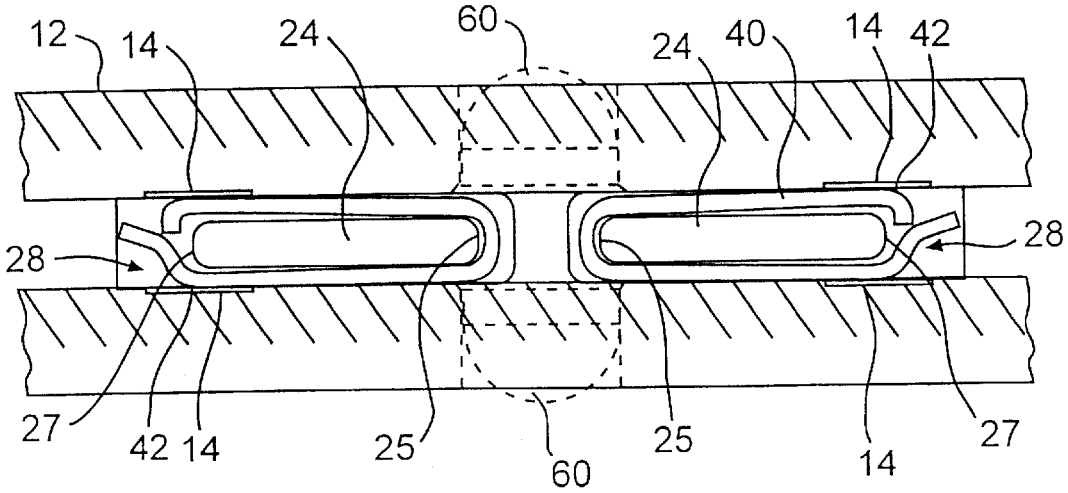
FIG. 5*b* is a cross-sectional view of the connector assembly of FIG. 4 taken along the lines indicated in a mated configuration between opposing circuit boards.

Referring to FIGS. 5*a* and 5*b*, upper resilient arm 40 includes a generally arcuate contact surface 42 defined by a radiused extension 44. Lower resilient arm 40 is defined also by a generally arcuate contact surface 42 and a generally horizontal extension 46. In the pressed mating configuration between circuit boards 12 illustrated in FIG. 5*b*, upper arm 40 is pressed into groove 28 and generally nest within lower arm 40, as illustrated in the figure. Arms 40 have enough resiliency so as to be in constant pressing contact against pads 14 without being soldered even when circuit board 12 rests against the upper surface 27 of each longitudinal leg 24, as particularly illustrated in FIG. 5*b*. Thus, the minimum stack height or vertical width of connector assembly 10 is generally defined by the upper and lower longitudinal surfaces of insulating body 18, and more particularly longitudinal legs 24. In this regard, arms 40 of connector elements 34 have a length so as generally extend over outward edge 27 of longitudinal leg 24 when in pressing mating contact with respective circuit boards 12, as illustrated in FIGS. 5*a* and 5*b*.

Each connector assembly 10 may also preferably include alignment structure to aid in precisely positioning the connector assembly relative to the circuit boards. For example, such structure may include male members 60 or female members 62 defined on opposite ends 22, 20 of body member 18. Male member 60 may be defined simply as a protruding member having a shape and configuration so as to engage in respective female structure 64 defined in circuit boards 12. Alternatively, female structure 62, which may be defined as a simple hole or recess, has a shape and configuration so as to engage with corresponding male structure defined on circuit boards 12. It should be appreciated by those skilled in the art that any manner of engaging structure can be utilized in this regard and that the embodiments illustrated in the figures are examples of but one suitable means.

Structure may also be provided to interconnect one or more of the connector assemblies 10. For example, referring to FIGS. 3 through 5*b*, single row connector assemblies 10 are shown connected to each other by way of the female/male engaging structure to define essentially a dual row connector assembly. In FIG. 3, the connected assembly is shown in phantom for sake of clarity. Two connected assemblies 10 are particularly illustrated in FIG. 4. The construction of each assembly 10 is the same, and such an assembly may be utilized for connecting dual rows of pads between facing circuit boards 12, such as illustrated in FIG. 3. It should thus be appreciated by those skilled in the art that any configuration of connected assemblies 10 may be utilized in this regard.

An alternative configuration of a dual row connector assembly is illustrated particularly in FIGS. 9 through 12. In this configuration, body member 18 includes two longitudinally extending legs 24 defined between ends 20, 22. The configuration of connectors 34 along each leg 24 may be as described above with regards to opposite resilient legs 40. In this embodiment, engaging structure is defined on ends 22 in the form of male protruding members 60. It should be understood that any configuration of engaging structures may be utilized in this regard. For example, the engaging structure could be defined as female receiving structures for mating engaging with male structures on the circuit boards.

Figure 10:
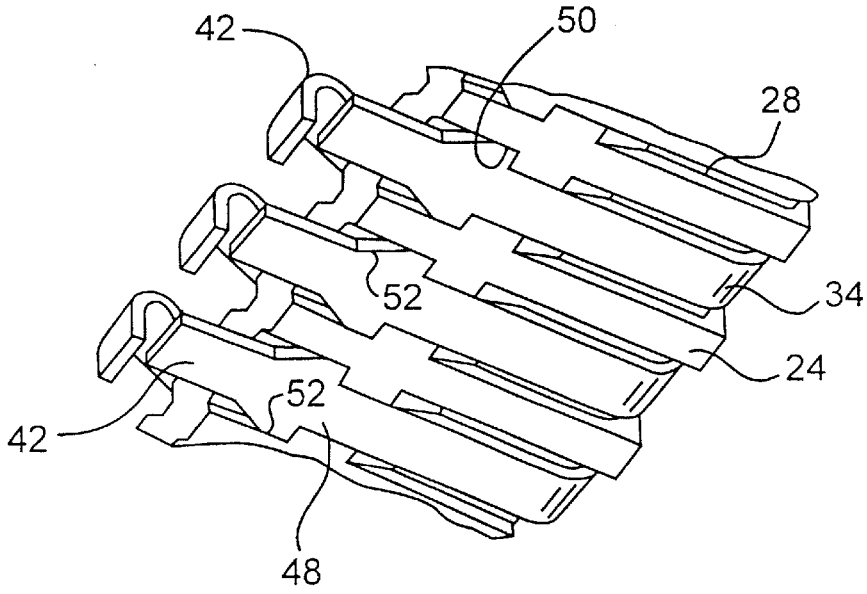
FIG. 10 is an enlarged underside view of the connector assembly shown in FIG. 9.
Figure 11:
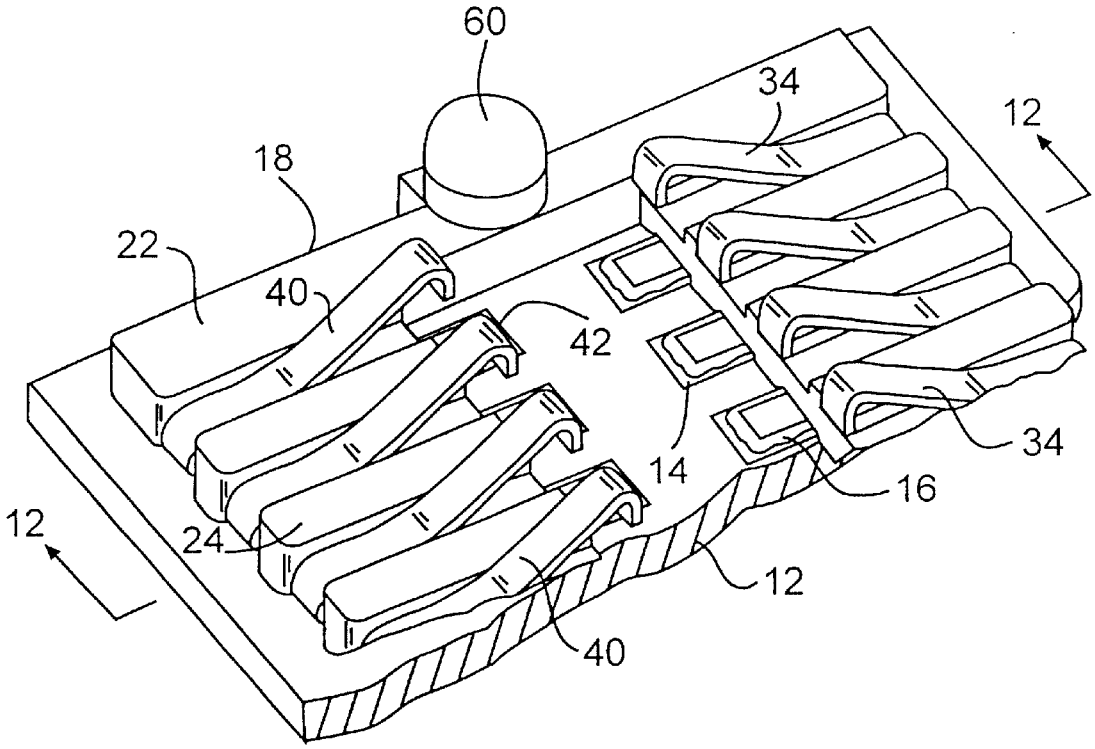
FIG. 11 is a partial perspective view of the connector assembly of FIG. 9 shown mated to a bottom circuit board.
Figure 12:
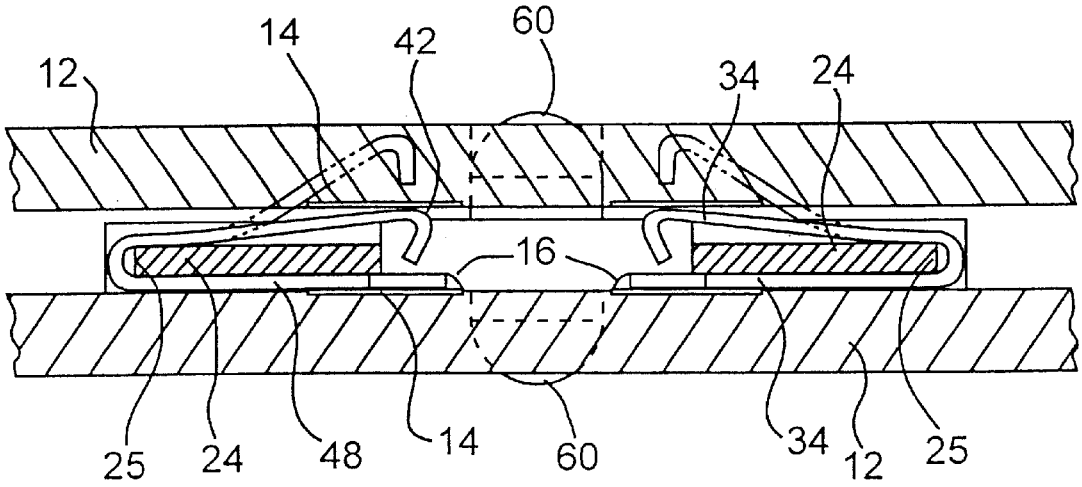
FIG. 12 is a cross-sectional view of the connector assembly of FIG. 9 shown mated between opposing circuit boards.

The embodiment of the connector assemblies illustrated in FIGS. 1 through 5*b* may be considered as a "solder-less" connector assembly since both of the contact surfaces 42 are defined on resilient arms that remain in pressing mating contact against pads 14 without the necessity of soldering each individual element 34 to pads 14. The resiliency of arms 40 ensures that connector elements 34 remain electrically connected to pads 14. However, in an alternative embodiment illustrated for example in FIGS. 9 through 12, connector elements 34 may include at least one generally rigid arm 48 defining a contact surface 42 at the end thereof. Rigid arm 48 is generally straight and rigidly set against a surface of longitudinal leg 24, for example within groove 28 so as to protrude just slightly above the outer surface of leg 24. In this regard, engaging structure may be defined for retaining rigid leg 48 relative to longitudinal leg 24. Referring to FIG. 10, this structure may include retaining recesses 50 defined generally at the end of each groove 28 for press-fitting contact with complimenting press-fit surfaces 52 defined on each connector element 34. In this embodiment, as illustrated in FIGS. 11 and 12, bottom rigid legs 48 are set on pads 14 of a bottom circuit board 12 and are conventionally soldered with solder 16 thereto. Thus, in this configuration, connector assembly 10 is permanently secured to at last one of the circuit boards.

The embodiments of FIGS. 9 through 12 illustrate the upper connector arm of each connector element 34 as a resilient arm 40, which operates as discussed above. However, it should be appreciated that each of the arms of connector elements 34 may actually comprise rigid arm members as discussed herein.

Figure 6:
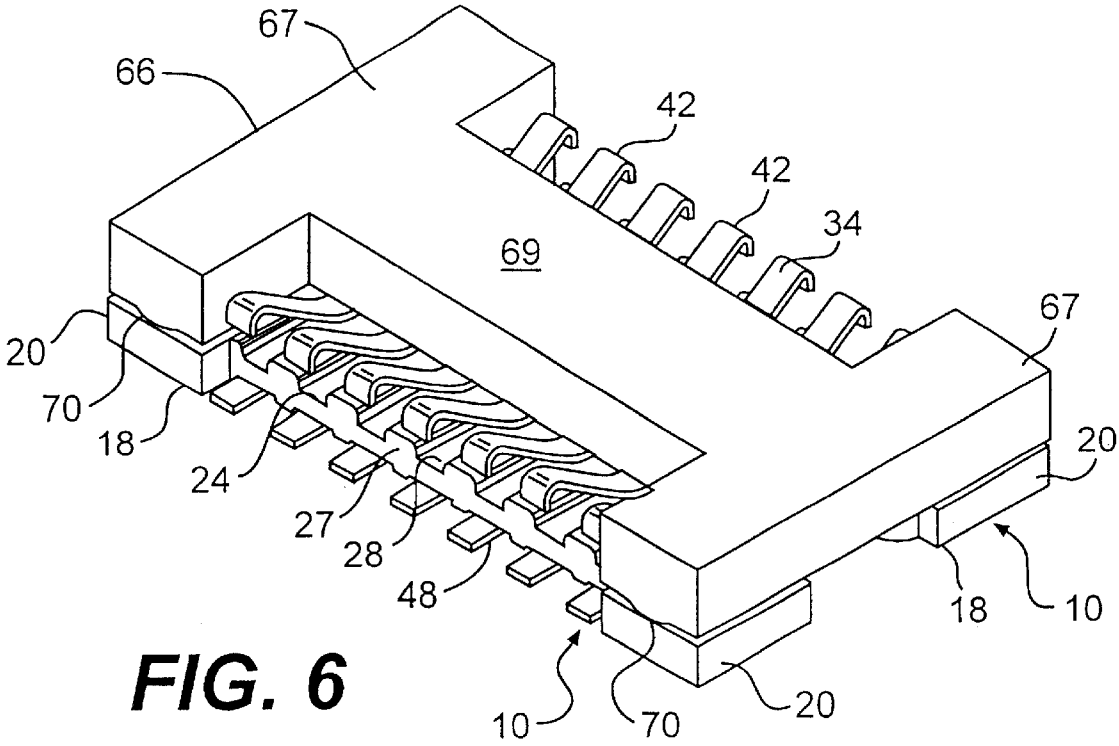
FIG. 6 is an alternative view of a dual connector configuration shown with a placement device.
Figure 7:
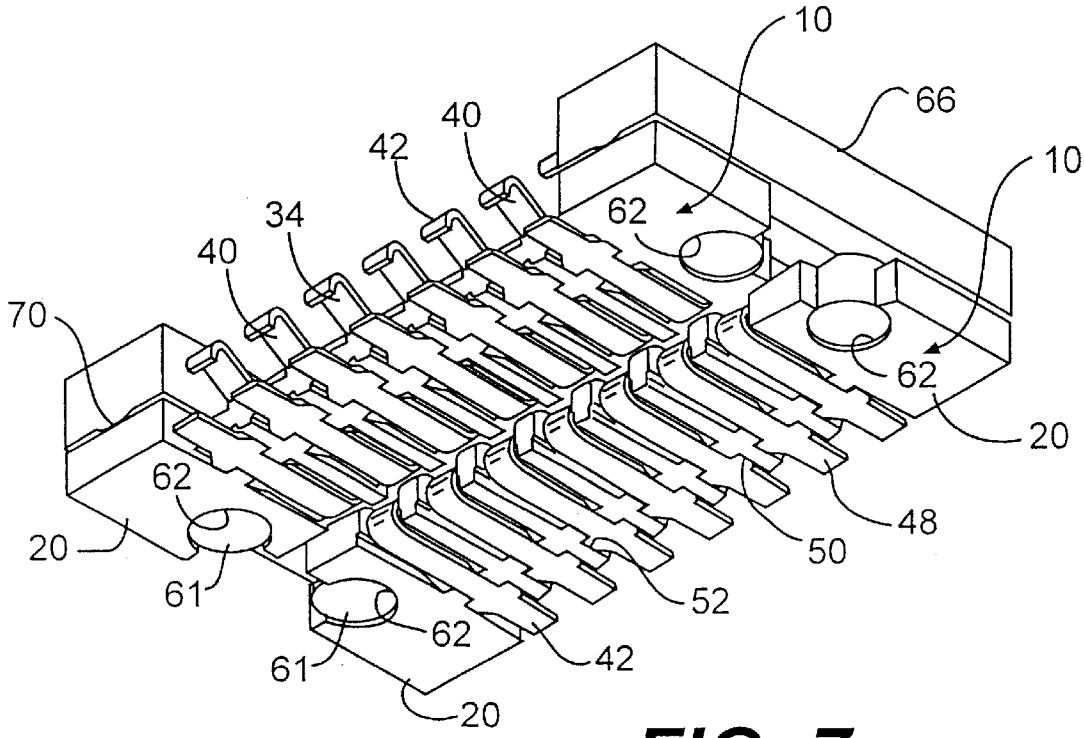
FIG. 7 is an underside view of the configuration shown in FIG. 6.
Figure 8:
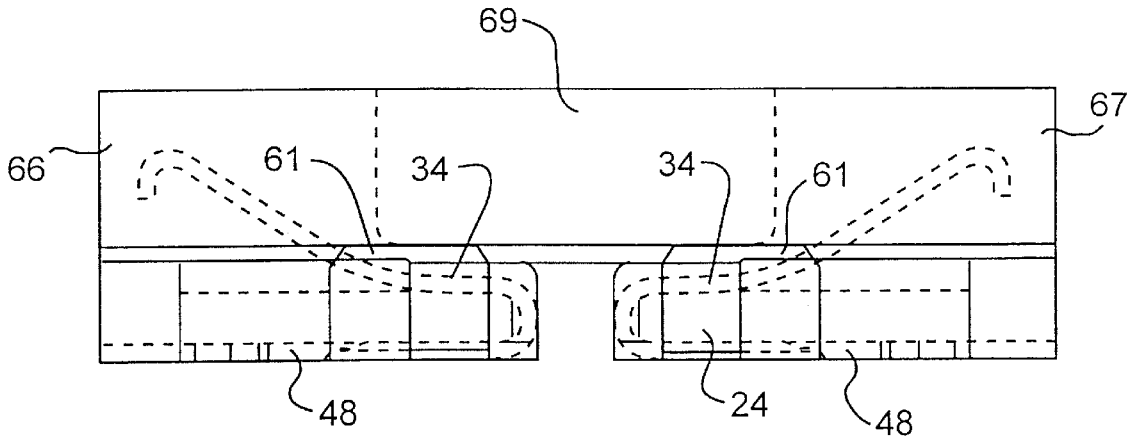
FIG. 8 is a cross-sectional view of the configuration of FIGS. 6 and 7.
Figure 9:
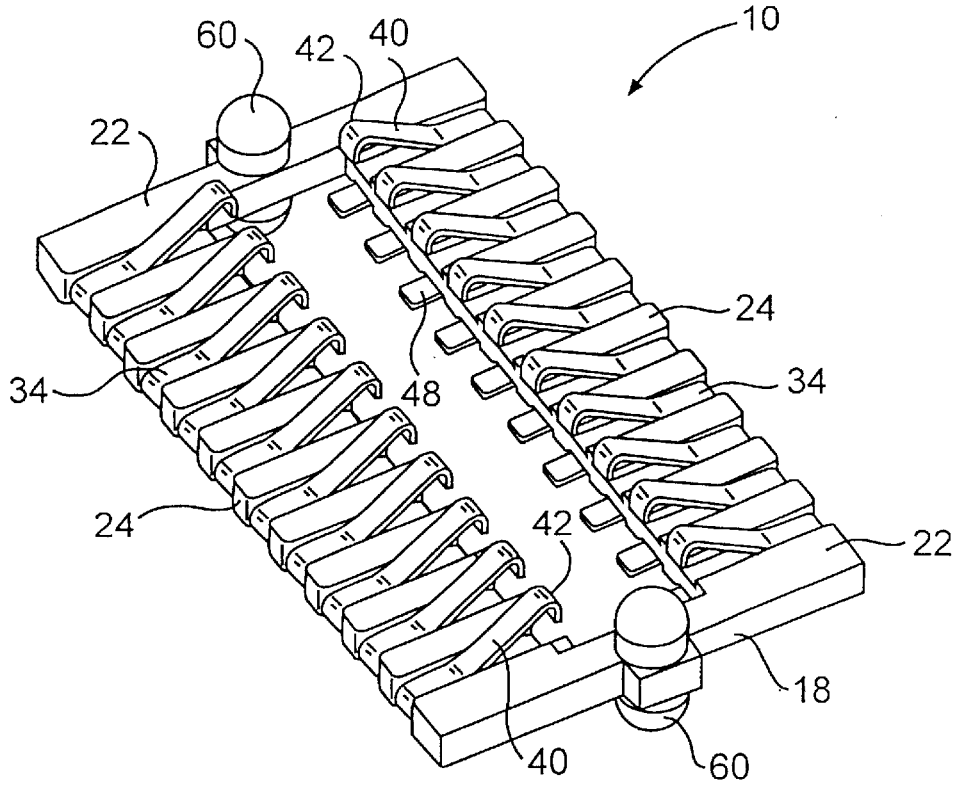
FIG. 9 is a perspective view of an alternate dual connector configuration.

FIGS. 6 through 8 illustrate an alternative configuration of a dual connector assembly according to the invention, and also a conventional method of positioning the connector assemblies relative to the circuit boards. FIGS. 6 and 7 illustrate two connector assemblies 10 releasably mounted onto a placement cap device 66. Cap device 66 has a general profile corresponding to the ends and longitudinal leg 24 of insulating body member 18. Each connector assembly 10 includes female engaging structure 62 for releasably engaging with male structure 61 defined on the underside of placement cap 66. In this regard, placement cap 66 includes end sections 67 spanning across each of the connector assemblies 10 with dual engaging members 61 defined on the underside thereof for engagement with each of the connector assemblies 10, as illustrated particularly in FIG. 7. A central section 69 extends between ends 67. Spacing nubs 70 are defined on the underside of ends 67 to maintain a separation between the ends of insulating body members 18 and the placement cap 66.

As generally known in the art, a suction nozzle or device attaches to placement cap 66 on the upper surface thereof and is used to precisely position connector assemblies 10 relative to the circuit boards. The placement cap 66 maintains connector assemblies 10 in position as bottom legs 48 soldered to their respective pads 14 on a lower circuit board 12, as generally illustrated in FIG. 12. Once connector assemblies 10 have been soldered in place, placement cap 66 can be removed simply by pulling the cap off of connector assemblies 10 and lower circuit board 12. The upper circuit board 12 is maintained in pressing mating contact against resilient arms 40 of the connector assemblies 10. Thus, in this embodiment, it is not necessary that engaging structure be defined between connector assembly 10 and the respective circuit board 12, although such structure could certainly be utilized.

Figure 13:
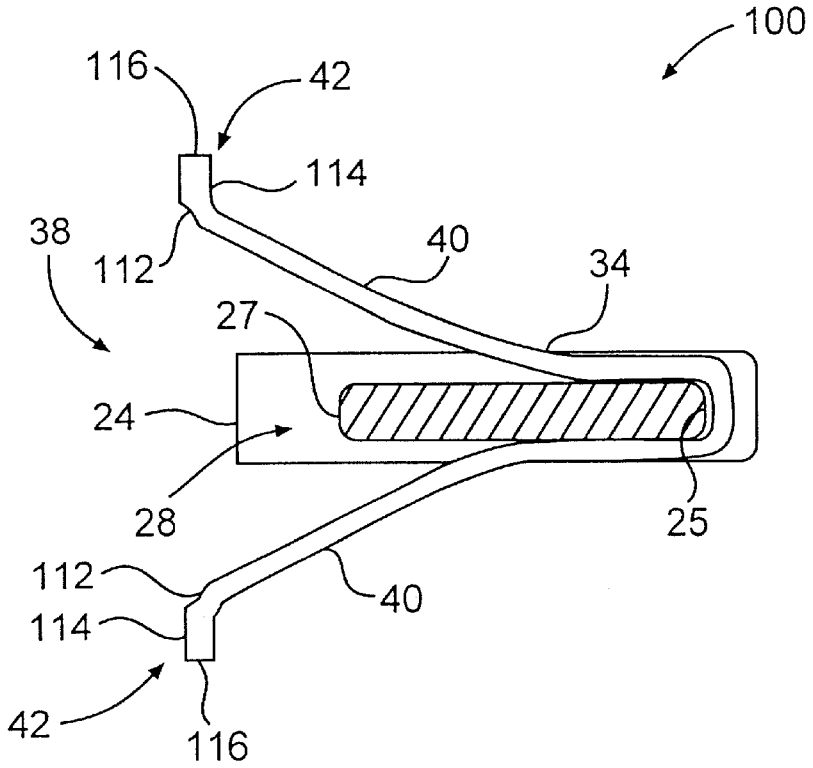
FIG. 13 is a cross-sectional view of an alternative connector configuration according to the invention particularly illustrating an alternative connector element.
Figure 14:
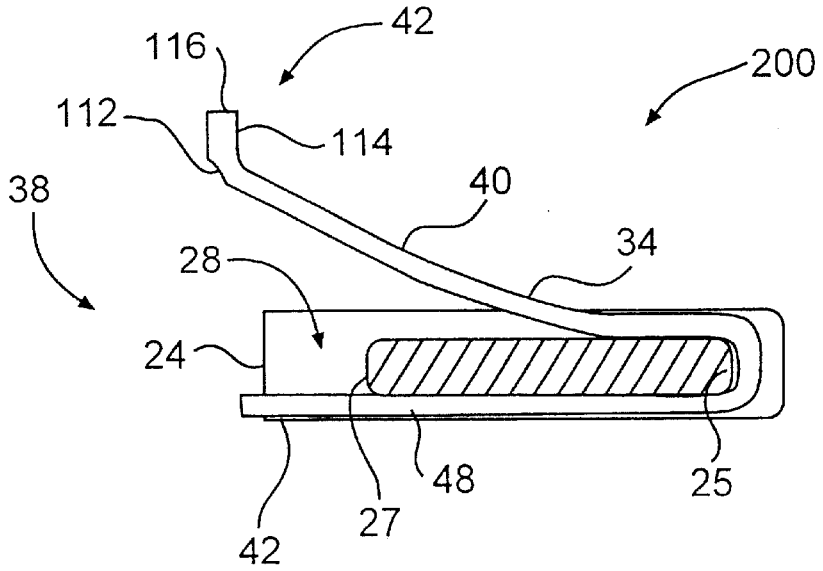
FIG. 14 is a cross-sectional view of still another embodiment of the connector assembly according to the invention particularly illustrating an alternative connector element.

Alternative embodiments of a connector assembly 100 and 200 are illustrated in FIGS. 13 and 14, respectively. Referring to FIG. 13, connector element 34 includes upper and lower resilient arms 40. Arms 40 are angled or bent outwardly and may be straight or have a outwardly concave shape. Arms 40 have a length so as to extend beyond edge 27 of longitudinal leg 24. In this embodiment, the contact surfaces 42 are defined by edges. To define contact surfaces 42, the ends 114 of arms 40 are bent at elbow 112 so that ends 116 are oriented generally in a plane parallel to the plane of longitudinal leg 24.

The embodiment of FIG. 14 is similar to that of FIG. 13 with the exception that the lower connector element leg 48 is a rigid surface mount leg having contact surface 42 defined thereon.

Still an alternative preferred embodiment of the connector assembly according to the invention is illustrated in FIGS. 15*a*–15*d*. In this embodiment, connector assembly 300 includes an insulating body member 18 composed of an upper longitudinal leg member 104 and a lower longitudinal leg member 106. The longitudinal leg members 104, 106 are spaced apart and separated by ribs 108. The insulating body 18 is hollow or contains spaces 110 between ribs 108. Thus, with this embodiment, it should be understood that the height profile of the connector assembly 300 is substantially greater than that of connector assembly 10 illustrated, for example, in FIGS. 5*a* and 5*b*.

Referring again to FIGS. 15*a*–15*d*, connector elements 34 include a back straight section 101 that extends between upper and lower longitudinal leg members 104, 106. Straight section 101 is defined between corners 102 that wrap around the upper and lower longitudinal leg members. Connector elements 34, particularly at the contacting surfaces 42 thereof, can take on any configuration of the connector elements discussed herein. In the embodiment of FIG. 15*a*–15*d*, contact surfaces 42 are defined generally near the ends of resilient arms 40 by bends or curves in the arms such that contact surfaces 42 extend across connector elements 34.

Figure 15A:
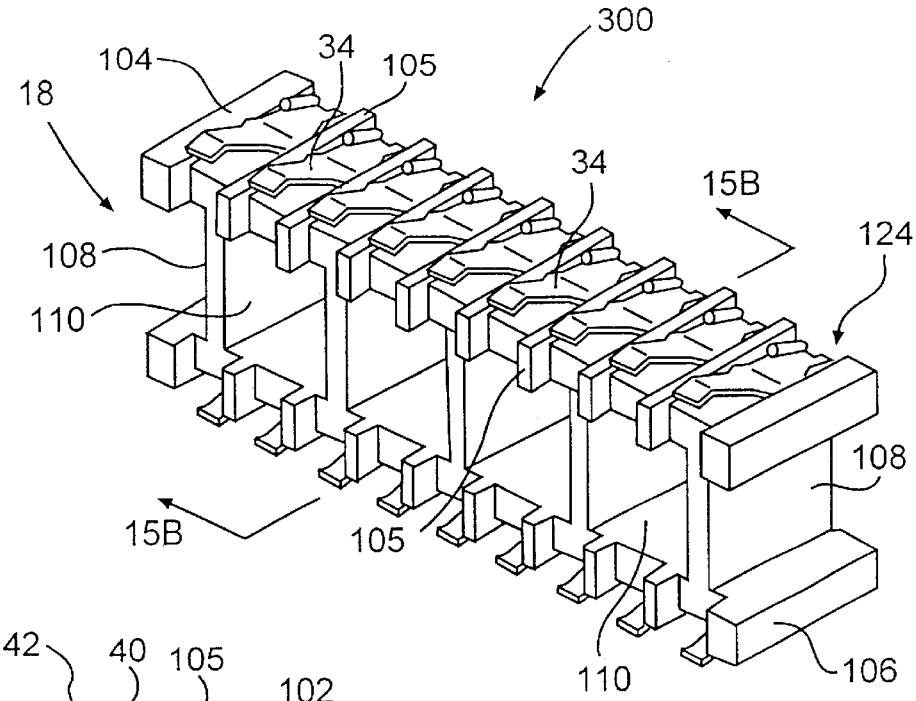
FIG. 15*a* is a perspective view of an alternate connector assembly according to the configuration, particularly illustrating an alternate configuration of an insulating body member.
Figure 15B:
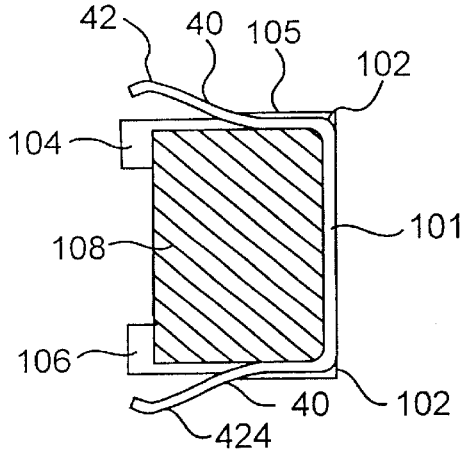
FIG. 15*b* is a cross-sectional view of the embodiment of FIG. 15*a* taken along the lines indicated.
Figure 15C:
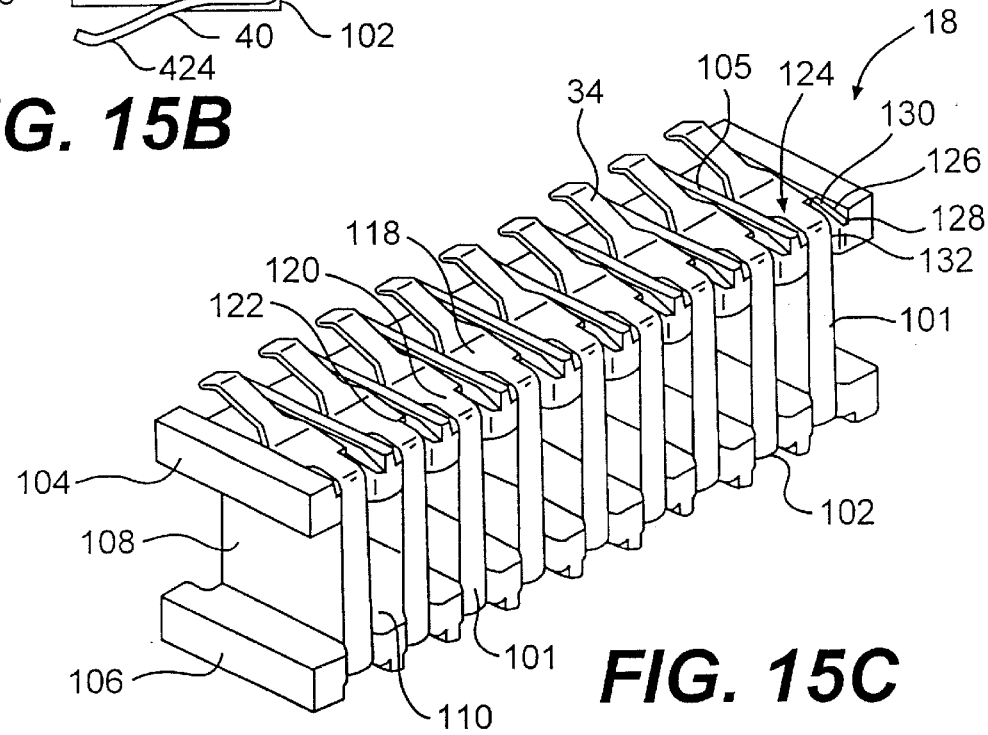
FIG. 15*c* is a different perspective view of the connector assembly of FIG. 15*a;*

Insulating body 18 also includes spaced apart body walls 105 defined on the upper and lower longitudinal leg members 104, 106, as particularly illustrated in FIGS. 15*a* and 15*c*. Body walls 105 define grooves or positioning locations for connector elements 34.

Figure 15D:
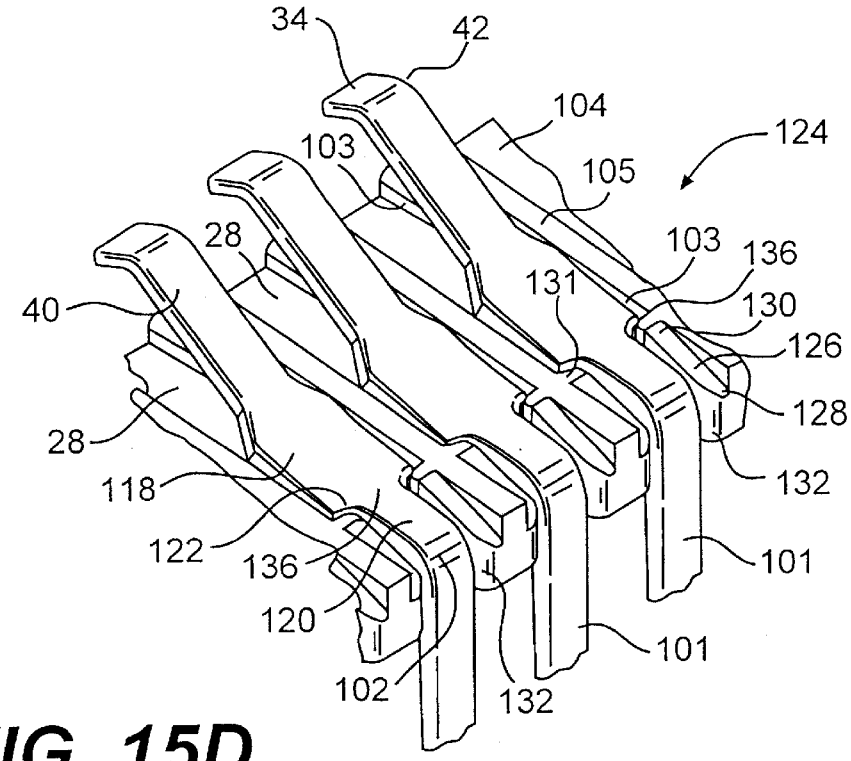
FIG. 15*d* is an enlarged perspective view particularly illustrating the retention device utilized to hold the connectors in the embodiment of FIG. 15*a;*
Figure 16A:
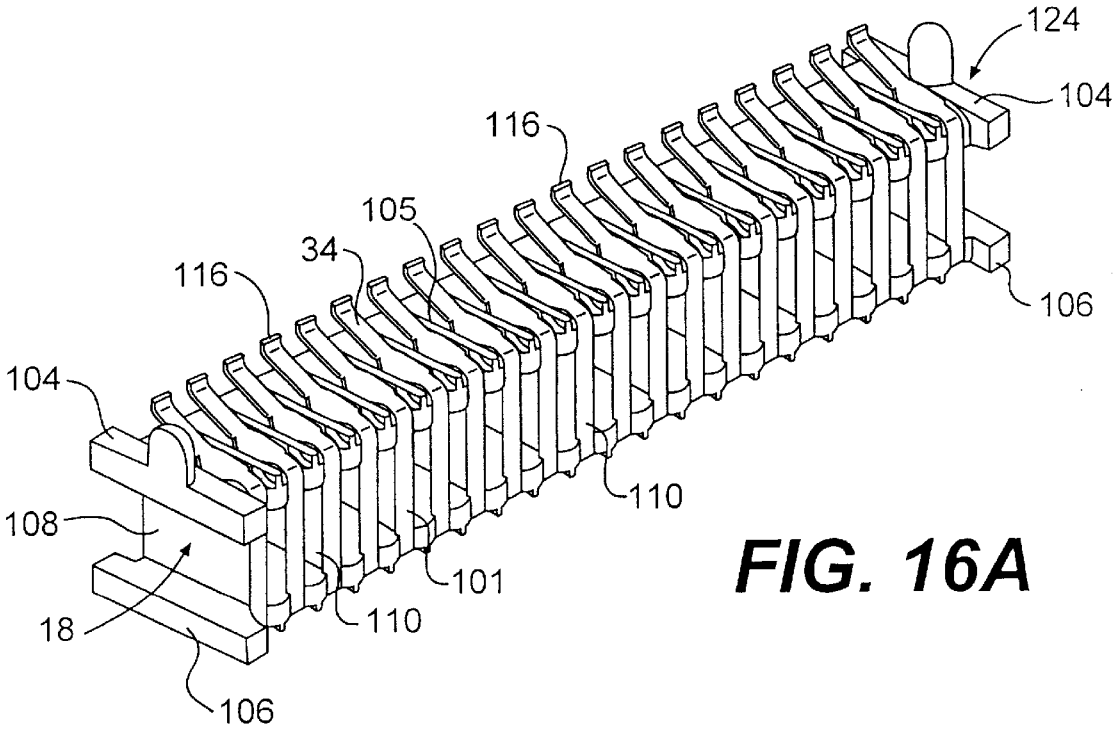
FIG. 16*a* is a perspective view of an additional embodiment of the connector assembly according to the invention utilizing the insulating body of FIG. 15*a* with an alternative configuration of connector elements 34.
Figure 16B:
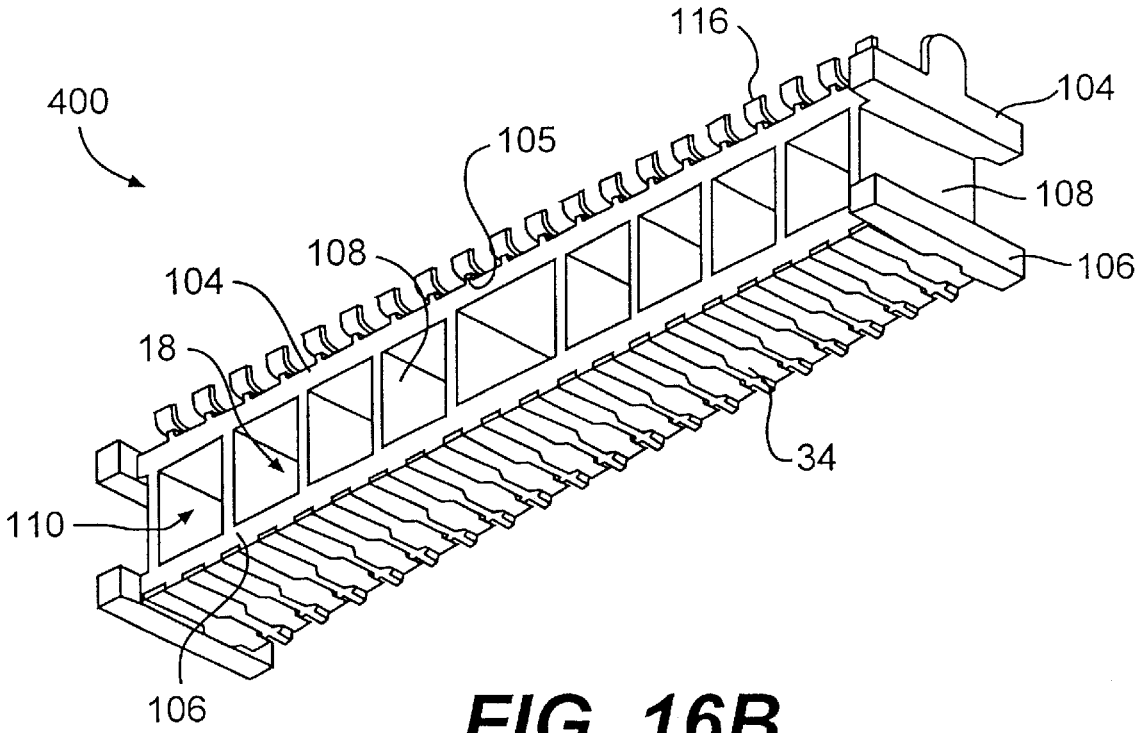
FIG. 16*b* is a different perspective view of the embodiment illustrated in FIG. 16*a;*
Figure 16C:
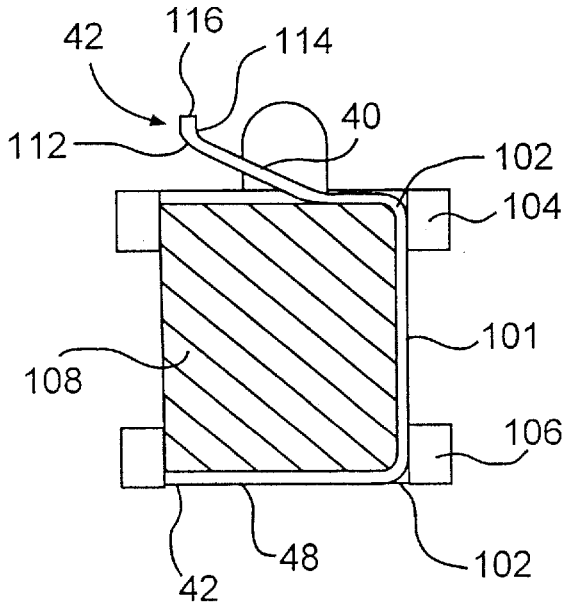
FIG. 16*c* is a cross-sectional view of the embodiment illustrated in FIG. 16*a;*

An alternative embodiment of connector assembly 400 is illustrated in FIGS. 16*a*–16*c*. This embodiment is similar to that of FIGS. 15*a*–15*d* with the exception of the configuration of connector elements 34. In this embodiment, the lower leg of connector element 34 is configured as a rigid surface mount leg 48. The upper connector element arm 40 is a resilient arm and is configured similar to the resilient arms of FIG. 13.

Figure 17:
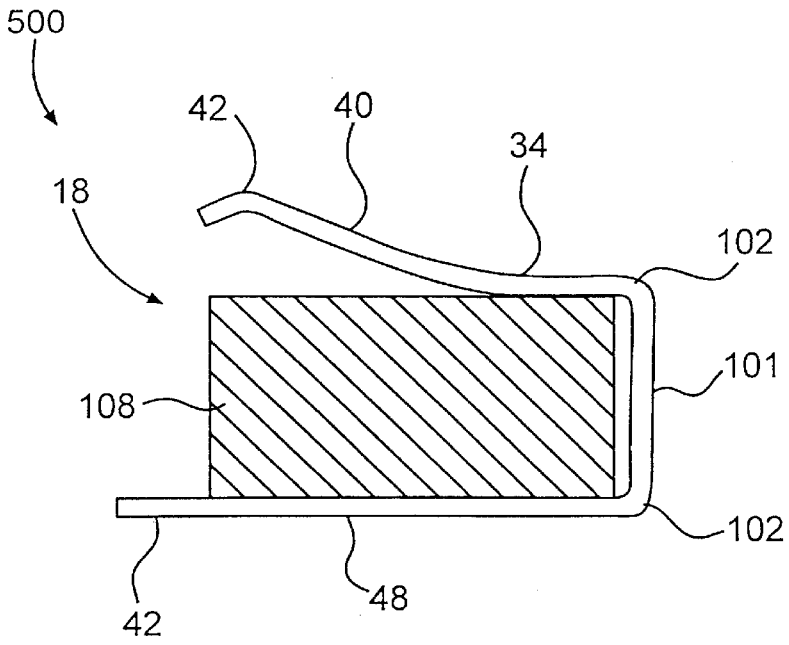
FIG. 17 is a cross-sectional view of alternative connector element configurations that may be utilized on the insulating body of FIGS. 15*a* and 16*a*.
Figure 18:
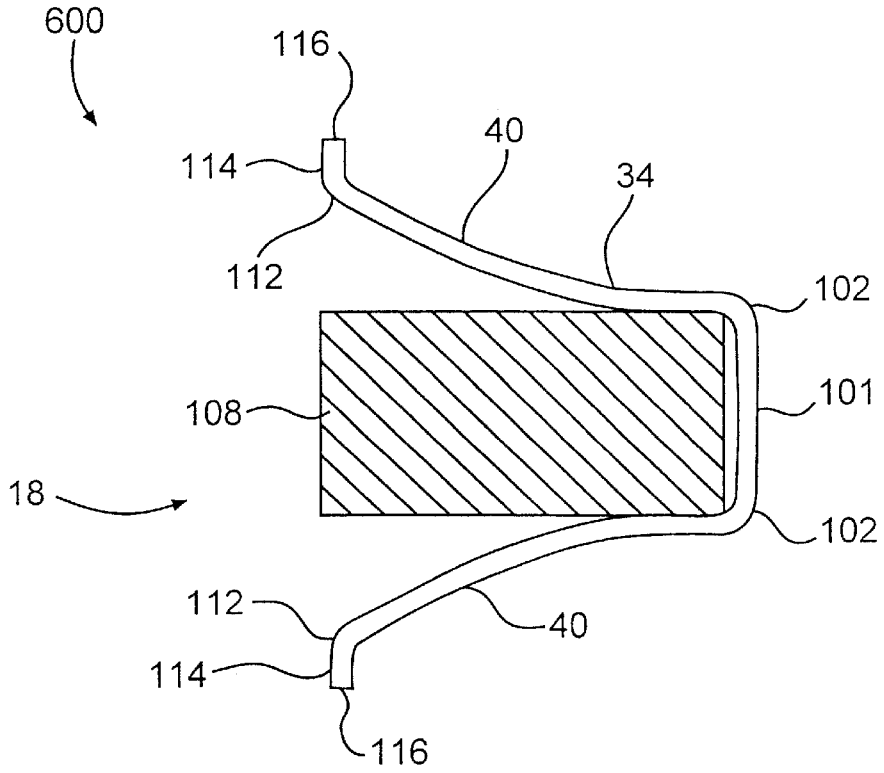
FIG. 18 is a cross-sectional view of still an alternative configuration of a connector element that may be used with the insulating bodies of FIGS. 15*a* and 16*a*.

The embodiments 500, 600 of alternate preferred connector assemblies are illustrated in FIGS. 17 and 18, respectively. Referring to FIG. 17, connector assembly 500 includes a connector element 34 incorporated with an insulating body 18 as described with regards to FIGS. 15*a*–15*d*. Connector element 34 has a resilient upper arm 40 with a contact surface 42 defined at a bend near the end thereof. Lower contact arm 48 is a rigid surface mount arm having a contact surface 42 defined near the end thereof. A generally straight section or back straight section 101 is defined between corners 102 of connector element 34.

The embodiment 600 of FIG. 18 is also incorporated on an insulating body 18 as in FIGS. 15*a*–15*d*. Connector element 34 has the same characteristics as the embodiment of FIG. 13 with the exception that a generally back straight section 101 is defined between corners 102.

The connector assemblies illustrated in FIGS. 15–18 also preferably include a retention device, generally 124. Retention device 124 has a configuration so as to engage and retain the closed end of connector elements 34 around at least the upper longitudinal leg 104 while still allowing connector elements 34 to be slid onto the leg. It should be appreciated and understood that retention device 124 as described herein may be utilized on any embodiments of the connector assemblies as described herein, including any embodiment illustrated in FIGS. 1–12.

Referring particularly to FIG. 15*d* wherein an enlarged view of the upper corners 102 of contact elements 34 is provided, retention device 124 includes cooperating engaging surfaces defined between upper leg member 104 and connector elements 34. These surfaces could also be provided lower leg member 106 and lower corner 102. Body walls 105 include inwardly projecting segments 132 defined generally at the ends thereof adjacent corner 102 of connector elements 34. Thus, the connector element grooves defined between body walls 105 has a reduced width between projecting segments 132. Connector elements 34 have a correspondingly reduced width section 120 at corner 102. Inclined surfaces 126 are defined on the inwardly projecting segments 132. Inclined surfaces 126 are inclined from a low point 128 to a high point 130. An upper ledge surface 131 is defined generally adjacent high point 130. Ledge 131 terminates in a generally vertical end wall 136. End wall 136 defines the beginning of the increased width section of the connector element groove 28. The connector elements 34 have an increased width section 118 corresponding generally to the width of the increased groove 28. Increased width section 118 is defined by shoulders 122 that abut against end walls 136 upon assembly of connector elements 34 onto insulating body 18.

With the structure of the retention device 124 illustrated in FIG. 15*d*, it is a relatively simple process to press connector elements 34 onto the insulating body 18. The closed end of connecter elements 34 are pressed onto body 18 such that the increased width sections 118 of connector elements 34 initially slide up inclined surfaces 126. As connector elements 34 are pushed progressively onto body 18, the increased width sections 118 slide onto ledge 131 until shoulders 122 drop into the increased width section of the groove and abut against end walls 136 of inwardly projecting segments 132. The decreased width sections 120 defined generally at the corners of the connector elements also fall between the inwardly projecting wall segments 132 and preferably abut against the wall segments 132. The present applicants have found that this embodiment of retention device 124 securely and firmly hold connector elements 34 to insulating body 18 without the use of any additional or external attaching devices, molding processes, or the like.

It should be appreciated by those skilled in the art that various modifications and variations can be made in the present invention without departing from the scope and spirit of the invention. For example, features illustrated as part of one embodiment can be used on another embodiment to yield still further embodiments. Such modifications and variations are within the scope and spirit of the invention and appended claims.

What is claimed is:

1. A thin profile electrical connector assembly for interconnecting conductive members, including circuit boards, in a stacked configuration, comprising:

at least one insulating body member having opposite ends and at least one longitudinally extending leg defined between said ends;

a plurality of adjacently disposed spaced apart connector positions defined along said leg;

a connector element disposed transverse to said leg at each said connector position, said connector elements comprising a closed end wrapping around and fitted onto said leg, and an open end defined by extending arms with each said arm having an outwardly facing contact surface defined thereon for mating contact with respective pads of separate facing conductive members; and wherein at least one of said arms is a resilient arm member angled away from and out of contact with said leg for pressing mating contact with a respective pad of one of the conductive members;

wherein at least a portion of one of said arms adjacent said closed end is in engaging contact with said leg in an unconnected state of said electrical connector to aid in securely positioning said connector element relative to said leg;

further wherein a retention device is provided upon said body member, said retention device having a configuration so as to engage and retain said closed end of said connector element around said leg while allowing said connector element to be slid onto said leg.

2. The connector assembly as in claim 1, wherein said connector positions comprise grooves defined at least partly around a circumference of said leg, said grooves further comprising positioning surfaces defined therein configured to retain and position said connector elements generally at said closed ends relative to said grooves.

3. The connector assembly as in claim 1, wherein said connector arms do not come into contact with each other when said connector assembly is operationally engaged between the conductive members.

4. The connector assembly as in claim 3, wherein the other of said connector arms is a generally rigid arm disposed adjacent an outer surface of said leg.

5. The connector assembly as in claim 3, wherein said resilient connector arm extends at an angle of generally less than 90 degrees from a longitudinal plane through said leg, said resilient arm movable towards said leg and into a groove defined in said leg upon being pressed against mating pads of a conductive member.

6. The connector assembly as in claim 5, wherein said resilient connector arm has a length so as to extend over said leg when pressed against mating pads of a conductive member.

7. The connector assembly as in claim 1, wherein the other said connector arm is also a resilient arm member angled away from and out of contact with said leg for pressing mating contact with a respective pad of one of the conductive members.

8. The connector assembly as in claim 7, wherein said resilient arms extend at angles of generally less than 90 degrees from a longitudinal plane through said leg, said resilient arms movable towards said leg into a groove defined in said leg upon being pressed against mating pads of the facing conductive members.

9. The connector assembly as in claim 8, wherein said resilient arms have a length so as to extend over said leg when pressed against mating pads of the facing conductive members.

10. The connector assembly as in claim 1, further comprising alignment structure defined on at least one of said ends of said insulating body, said alignment structure having a configuration so as to engage with complimenting structure on the conductive members to precisely position said connector assembly relative to the conductive members.

11. The connector assembly as in claim 10, wherein said alignment structure comprises one of a male or female member for engagement with a respective female or male member on the conductive member.

12. The connector assembly as in claim 1, wherein said body member comprises two said longitudinally extending legs defined between said ends with respective said connector elements disposed along each said leg.

13. The connector assembly as in claim 1, wherein said assembly comprises a height of less than about 1.0 mm between opposite connector arms.

14. The connector assembly as in claim 1, wherein said body member further comprises engaging structures defined thereon so that said connector assembly can be removably attached to a positioning cap for placement on a conductive member.

15. The connector assembly as in claim 14, wherein said engaging structures also serve as positioning and alignment structures matable with complimenting structure on the conductive members.

16. The connector assembly as in claim 1, further comprising a placement cap, said body member removably connected to said placement cap wherein said placement cap aids in positioning of said body member on a conductive member and is subsequently removable from said body member.

17. The connector assembly as in claim 16, comprising a plurality of said body members connected to said placement cap.

18. A thin profile electrical connector assembly for interconnecting circuit boards in a stacked configuration, comprising:

an insulating body member having opposite ends and at least one longitudinally extending leg defined between said ends;

a plurality of open-ended connector elements disposed transverse to and spaced apart along said leg, said connector elements comprising a closed end wrapping around and engaged in contact with said leg; and an open end defined by arms extending transversely across said leg wherein at least one of said arms is a resilient arm angled away from said leg;

an outwardly facing contact surface defined on each of said arms for mating contact with respective pads of separate facing circuit boards; and wherein at least said resilient arm has a length so as to extend along said leg in the transverse direction when pressed in mating contact against a circuit board;

wherein a retention device is configured with said connector assembly so as to engage and retain the closed end of the connector element around the leg while allowing the connector element to be slid onto the leg.

19. The connector assembly as in claim 18, further comprising spaced apart connector element grooves defined at least partly around a circumference of said leg, said resilient arms movable into said grooves upon being pressed in mating contact against a circuit board without contacting said leg along the complete length thereof within said groove.

20. The connector assembly as in claim 19, wherein said resilient arms further comprise a radiused end portion defining said contact surfaces thereof, said radiused end extending over a longitudinal edge of said leg towards the other said arm without contacting said other arm when said connector assembly is operationally engaged between mated circuited boards.

21. The connector assembly as in claim 20, wherein the other of said connector arms is a generally rigid arm disposed generally against an outer surface of said leg.

22. The connector assembly as in claim 18, wherein the other said connector arm is also an angled resilient arm having a length so as to extend over said leg in the transverse direction.

23. The connector assembly as in claim 22, wherein said resilient arms extend at angles of generally less than 90 degrees from a longitudinal plane through said leg, said resilient arms movable towards said leg into a groove defined in said leg upon being pressed against mating pads of the facing circuit boards.

24. The connector assembly as in claim 23, wherein said resilient arms do have a length so as not to contact when extended over said leg when pressed against mating pads of the facing circuit boards.

25. The connector assembly as in claim 1, wherein said closed end of said U-shaped connector element is continuously curved between said arms.

26. The connector assembly as in claim 1, wherein said closed end of said U-shaped connector element comprises a generally straight section between curved corners that merge into said arms.

27. The connector assembly as in claim 26, wherein said leg comprises upper and lower longitudinally extending members separated by generally transversely extending rib members, said generally straight section of said connector element closed end extending between said longitudinally extending members and said curved corners wrapping around said longitudinally extending members.

28. The connector assembly as in claim 27, wherein said leg is generally hollow between said rib members.

29. The connector assembly as in claim 1, wherein at least one of said contact surfaces of said connector element arms is defined by a bend in said arm proximate an extreme end of said arm, said contact surface defined generally at the location of said bend.

30. The connector assembly as in claim 1, wherein at least one of said contact surfaces of said connector element arms comprises an extreme edge of said arm, said edge oriented so as to be outwardly facing relative to said leg.

31. The connector assembly as in claim 30, wherein said arm comprises a bend proximate an extreme end thereof so as to orient said edge to be outwardly facing.

32. The connector assembly as in claim 1, further comprising a retention device configured with said body member, said retention device having a configuration so as to engage and retain said closed end of said connector element around said leg while allowing said connector element to be slid onto said leg.

33. The connector assembly as in claim 1, wherein said retention device comprises inclined surfaces disposed on either side of said leg at said connector position, at least an upper said arm of said connector element sliding up said inclined surfaces upon pressing said connector element onto said leg.

34. The connector assembly as in claim 33, wherein said connector position is defined as a groove between facing sides of walls that extend generally transversely across said leg, said inclined surfaces defined at ends of said walls adjacent said connector element closed end.

35. The connector assembly as in claim 34, wherein said inclined surfaces are defined on inwardly projecting segments of said walls so that said groove has a reduced width between said segments, said connector element having a correspondingly reduced width at said closed end thereof.

36. The connector assembly as in claim 33, wherein said connector position is defined as a groove between facing sides of walls extending transversely across said leg, said inclined surfaces defined on inwardly projecting segments of said walls proximate to ends of said walls so that said connector position between said segments has a reduced width, each said inclined surface terminating in a generally vertical end wall, said connector element comprising a reduced width section at said closed end corresponding to said reduced width of said connector position between said inwardly projecting segments, and shoulders abutting said end walls.

37. The connector assembly as in claim 34, wherein said resilient connector arm moves into said groove upon being pressed into electrical connect against an adjacent conductive member.

* * * * *